US006929093B1

(12) United States Patent
Land

(10) Patent No.: US 6,929,093 B1
(45) Date of Patent: Aug. 16, 2005

(54) ACCESSORY FOR A LADDER

(76) Inventor: Marilyn S. Land, 11514 57th Rd. North, Royal Palm Beach, FL (US) 33411

( * ) Notice: Subject to any disclaimer, the term of this patent is extended or adjusted under 35 U.S.C. 154(b) by 0 days.

(21) Appl. No.: 10/669,267

(22) Filed: Sep. 25, 2003

(51) Int. Cl.[7] ..... E04G 3/16; E04G 5/02; E04G 3/00

(52) U.S. Cl. ..... 182/13; 182/107; 182/16; 182/129

(58) Field of Search ..... 182/13–17, 108, 182/127, 129, 20, 39, 107, 214

(56) References Cited

U.S. PATENT DOCUMENTS 1,912,509 A 9/1933 Ballard
2,320,407 A 6/1943 Campbell
3,175,641 A 3/1965 Minhalik
3,735,838 A 5/1973 Greenleaf
4,911,263 A * 3/1990 Kuperman ..... 182/13

* cited by examiner

*Primary Examiner*—Hugh B. Thompson, II
(74) *Attorney, Agent, or Firm*—Donald R. Schoonover

(57) ABSTRACT

An accessory for a ladder includes a set of wheels that can be attached to the feet of the ladder and a gear mechanism that couples those wheels to an operating handle. The operating handle includes a plurality of sections so it can be reached by a user who is supported on top of the ladder. Operation of the handle rotates the wheels to move the ladder while the user remains in place on the ladder.

1 Claim, 1 Drawing Sheet

ACCESSORY FOR A LADDER

BACKGROUND OF THE INVENTION

1. Field of the Invention

The present invention relates to the general art of ladders, and to the particular field of accessories for ladders.

2. Discussion of Related Art

Ladders are one of the most common items used in the construction and building arts. Often, a user must use a ladder to reach a wide range of locations for a single job. In such an instance, the ladder must be moved from place to place. Stocking shelves, moving books and the like are examples of jobs that may require a ladder to be moved after it has initially been placed in a desired location. This may require the user to descend the ladder to move it to the next location and then ascend the ladder to complete the work at that location.

This can be a time consuming task and may be tiring since the user sometimes must ascend and descend the ladder several times to complete a job. Since time is wasted going up and down a ladder, completion of a job may take more time than necessary. This can be costly as well as time consuming.

Therefore, there is a need for a means for moving a ladder without requiring a user to dismount from the ladder.

Safety is an important consideration when using a ladder as an error could result in a long and dangerous fall. Therefore, there is a need for a means for moving a ladder without requiring a user to dismount from the ladder, which can be used in a safe manner.

A workman may have several ladders so different jobs can be accommodated. To be cost effective, any accessory should be amenable to use on a variety of ladders. However, since safety is such an important consideration, safety should not be compromised by use of an accessory on any ladder.

Therefore, there is a need for a means for moving a ladder without requiring a user to dismount from the ladder and which is amenable for use on a variety of ladders without sacrificing safety considerations.

PRINCIPAL OBJECTS OF THE INVENTION

It is a main object of the present invention to provide a means for moving a ladder without requiring a user to dismount from the ladder.

It is another object of the present invention to provide a means for moving a ladder without requiring a user to dismount from the ladder, which can be used in a safe manner.

It is another object of the present invention to provide a means for moving a ladder without requiring a user to dismount from the ladder and which is amenable for use on a variety of ladders without sacrificing safety considerations.

SUMMARY OF THE INVENTION

These, and other, objects are achieved by an accessory for a ladder which comprises: a plurality of wheels, each wheel having an attaching mechanism thereon which attaches the wheel to the foot of a ladder when the wheel is in use; an element that attaches two wheels of the plurality of wheels together when the two wheels are in place on the ladder; a gear mechanism mounted on one wheel of the two wheels, the gear mechanism including a gear wheel mounted on the one wheel, the gear wheel including a plurality of gear teeth; and an operating handle that has a distal end sized to engage the gear teeth of the gear wheel to rotate the gear wheel.

Once the user has ascended the ladder, the user need not descend the ladder and dismount the ladder in order to move the ladder to a new location. Movement of the ladder can be effected by the user operating the control handle while the user is still on the ladder. This saves time that would otherwise be wasted by the user descending the ladder, dismounting the ladder, moving the ladder to a new location, then re-ascending the ladder. Safety is achieved by moving the ladder in very small steps. The accessory embodying the present invention can be easily and quickly moved from one ladder to another and thus is amenable for use with a wide variety of ladders, yet will retain the safety features associated with the accessory.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 2:
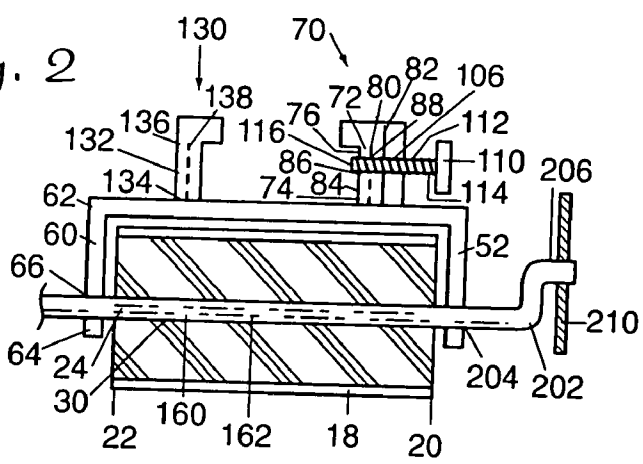
FIG. 2 is an enlarged cross-sectional view taken along line 2—2 of FIG. 1.
Figure 3:
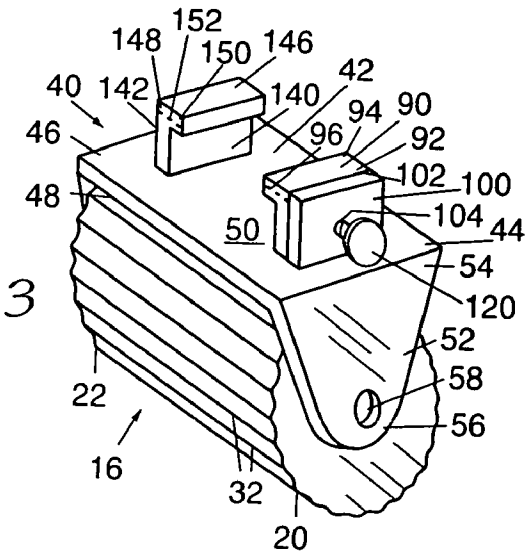
FIG. 3 is an enlarged perspective view of a wheel that can be used in connection with a set of ladder legs.

Referring to the Figures, it can be understood that the present invention is embodied in an accessory 10 for a ladder L that is used to move the ladder without requiring a person to descend from the ladder whereby the ladder can be moved by the person while he or she remains on the ladder. Accessory 10 comprises a set of wheels adapted to be mounted on the feet F of a ladder. The set of wheels includes a first wheel 12, a second wheel 14, and third and fourth wheels, such as third wheel 16 shown in FIG. 3. Each of the wheels is identical to the other wheels and each wheel has a cylindrical body 16 that can be constructed of rubber or other suitable material, and which has an outer surface 18. Each wheel further includes a first end 20, a second end 22, and a longitudinal axis 24 which extends between the first end 20 and the second end 22.

An axial bore 30 extends along the longitudinal axis 24 between the first end 20 and the second end 22, and longitudinal ribs, such as rib 32, are located on the outer surface 18 of the cylindrical body 16. The longitudinal ribs 32 extend from the first end 20 to the second end 22 of the body 16.

A U-shaped bracket 40 is fixed to each of the wheels. Each U-shaped bracket 40 includes a bight section 42, which has a first end 44 and a second end 46. The first end 44 of the bight section 42 is located adjacent to the first end 20 of the wheel associated with the bracket 40 and the second end 46 of the bight section 42 is located adjacent to the second end 22 of the wheel associated with the bracket 40. The bight section 42 further includes a first surface 48 located closely adjacent to the wheel associated with the bracket 40 and a second surface 50.

A first leg 52 is located on the first end 44 of the bight section 42. The first leg 52 is located closely adjacent to the first end 20 of the wheel associated with the bracket 40. The first leg 52 has a proximal end 54 that is unitary with the bight section 42 and a distal end 56 that is located closely adjacent to the axial bore 30 in the wheel associated with the bracket 40. The first leg 52 has an axle-accommodating hole 58 defined therethrough in the distal end 56 thereof. The axle-accommodating hole 58 is aligned with the axial bore 30 in the wheel associated with the bracket 40.

A second leg 60 is on the second end 46 of the bight section 42. The second leg 60 is located closely adjacent to the second end 22 of the wheel associated with the bracket 40. The second leg 60 has a proximal end 62 that is unitary with the bight section 42 and a distal end 64 that is located closely adjacent to the axial bore 30 in the wheel associated with the bracket 40. The second leg 60 has an axle-accommodating hole 66 defined therethrough in the distal end 64 thereof. Axle-accommodating hole 66 is aligned with the axial bore 30 in the wheel associated with the bracket 40.

A first L-shaped mounting element 70 is located on the second surface 50 of the bight section 42 adjacent to the first end 44 of the bight section 42 of the bracket 40. The first L-shaped mounting element 70 includes a body 72 having a proximal end 74 and a distal end 76. Proximal end 74 is unitary with the bight section 42 of the bracket 40, and the distal end 76 of the body 72 of the first L-shaped mounting element 70 is spaced apart from the second surface 50 of the bight section 42 of the bracket 40.

A longitudinal axis 80 extends between the distal end 76 of the body 72 of the first L-shaped mounting element 70 and the proximal end 74 of the body 72 of the first L-shaped mounting element 70. Longitudinal axis 80 of the body 72 of the first L-shaped mounting element 70 is oriented at a right angle with respect to longitudinal axis 24 of the bight section 42 of the bracket 40.

The body 72 of the first L-shaped mounting element 70 further includes a first surface 82 and a second surface 84.

A first L-shaped mounting element fastener accommodating hole 86 is defined through the body 72 of the first L-shaped mounting element 70 from the first surface 82 to the second surface 84 near the distal end 76 of the body 72 of the first L-shaped mounting element 70. The body 72 of the first L-shaped mounting element 70 has a screw thread 88 defined thereon adjacent to the fastener accommodating hole 86 of the first L-shaped mounting element 70.

A head 90 is unitary with the distal end 76 of the body 72 of the first L-shaped mounting element 70. Head 90 has a proximal end 92 unitary with the distal end 76 of the body 72 of the first L-shaped mounting element 70 and a distal end 94 spaced apart from the distal end 76 of the body 72 of the first L-shaped mounting element 70. Head 90 also includes a longitudinal axis 96, which extends between the proximal end 92 of the head 90 and the distal end 94 of the head 90 and which extends in the direction of the longitudinal axis 24 of the bight section 42 of the bracket 40 towards the second end 46 of the bight section 42 of the bracket 40.

A securing mechanism 100 is on the first surface 82 of the body 72 of the first L-shaped mounting element 70. Securing mechanism 100 includes a mounting element 102 fixedly mounted on the first surface 82 of the body 72 of the first L-shaped mounting element 70. Mounting element 102 of the securing mechanism 100 includes a fastener accommodating hole 104 defined therethrough to be coincident with the fastener accommodating hole 86 defined through the body 72 of the first L-shaped mounting element 70. The securing mechanism 100 further includes a screw thread 106 defined on the body of the securing mechanism 100 adjacent to the fastener accommodating hole 104 defined through the body of the securing mechanism 100. A fastener 110 is accommodated in the fastener accommodating holes 104 defined through the mounting element 102 of the securing mechanism 100 and the hole 86 defined through the body 72 of the first L-shaped mounting element 70. The fastener 110 of the securing mechanism 100 includes a screw thread 112 that is threadably accommodated in the screw thread 106 of the securing mechanism 100 and the screw thread 88 of the first L-shaped mounting element 70. The fastener 110 further includes a first end 114, a second end 116, and a head 120 on the first end 114. The second end 116 of the fastener 110 is adapted to abuttingly engage one surface of a leg of the ladder when the wheel associated therewith is in place on the foot of the ladder.

A second L-shaped mounting element 130 is on the second surface 50 of the bight section 42 adjacent to the second end 46 of the bight section 42 of the bracket 40. The second L-shaped mounting element 130 includes a body 132 having a proximal end 134 and a distal end 136. Proximal end 134 is unitary with the bight section 42 of the bracket 40 and distal end 136 is spaced apart from the second surface 50 of the bight section 42 of the bracket 40. Second L-shaped mounting element 130 further includes a longitudinal axis 138 which extends between the distal end 136 of the body 132 of the second L-shaped mounting element 130 and the proximal end 134 of the body 132 of the second L-shaped mounting element 130. Longitudinal axis 138 of the body 132 of the second L-shaped mounting element 130 is oriented at a right angle with respect to the longitudinal axis 24 of the bight section 42 of the bracket 40.

Second L-shaped mounting bracket 130 further includes a first surface 140 on the body 132 of the second L-shaped mounting element 130 and a second surface 142 on the body 132 of the second L-shaped mounting element 130.

A head 146 is unitary with the distal end 136 of the body 132 of the second L-shaped mounting element 130. Head 146 of the second L-shaped mounting element 130 has a proximal end 148 that is unitary with the distal end 136 of the body 132 of the second L-shaped mounting element 130 and a distal end 150 spaced apart from the distal end 136 of the body 132 of the second L-shaped mounting element 130. Head 146 of the second L-shaped mounting element 130 includes a longitudinal axis 152 which extends between the proximal end 148 of the head 146 of the second L-shaped mounting element 130 and the distal end 150 of the head 146 of the second L-shaped mounting element 130, extending in the direction of the longitudinal axis 24 of the bight section 42 of the bracket 40 towards the first end 44 of the bight section 42 of the bracket 40.

Figure 1:
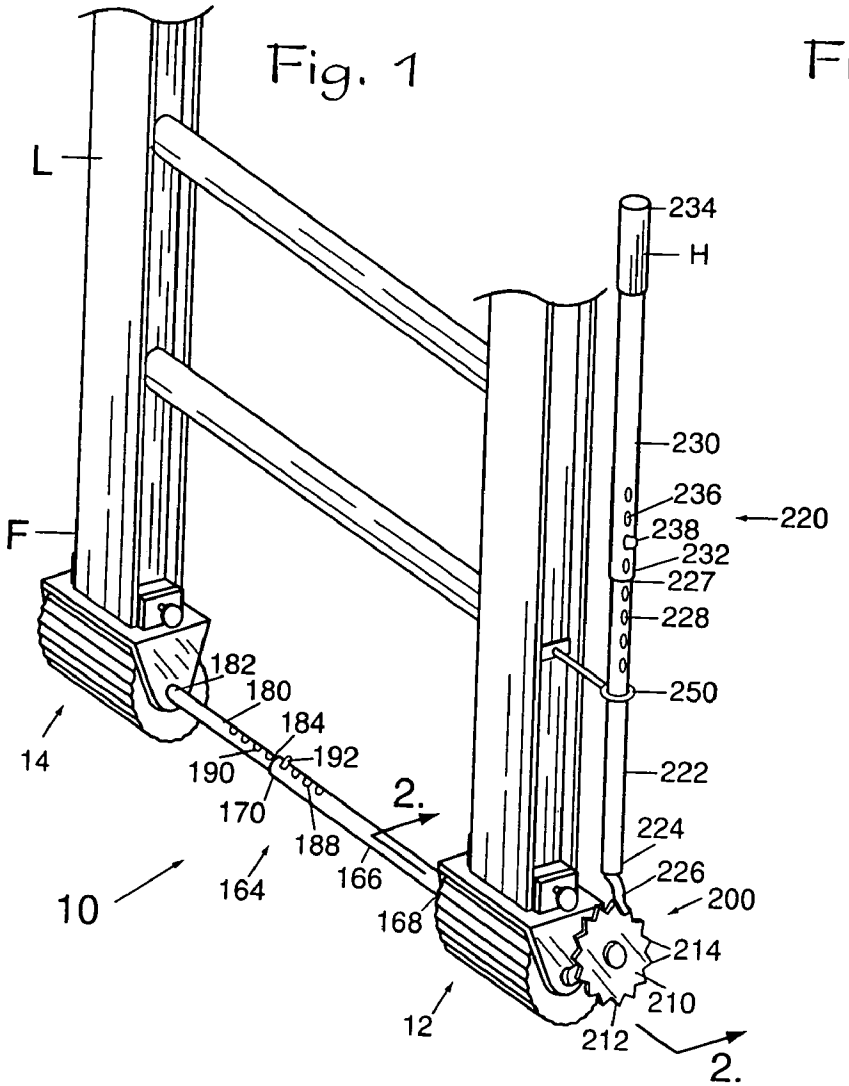
FIG. 1 is a perspective view of a portion of a ladder having the accessory embodying the present invention mounted thereon.

As can be understood from FIG. 1, when the one end of the fastener 110 of the securing mechanism 100 on the first L-shaped securing element 70 is abuttingly engaged with the leg of the ladder, the U-shaped bracket 40 associated with the securing mechanism 100 is secured to the ladder.

An axle 160 extends through the axial bore 30 in each wheel. The axle 160 is rotatably supported by the first and second legs 52, 60 of the bracket 40 associated with each wheel adjacent to the axle-accommodating holes 58, 66 defined in the first and second legs 52, 60 whereby each of the wheels is rotatably mounted on a U-shaped bracket 40 by an axle 160. Each axle 160 has a longitudinal axis 162.

An axle extension 164 extends between the first and second wheels 12, 14. Axle extension 164 includes a first section 166. First section 166 of the axle extension 164 is aligned with the axle 160 in the first wheel 12. First section 166 of the axle extension 164 includes a proximal end 168 that is unitary with the axle 160 in the first wheel 12 and a distal end 170 that is located between the first wheel 12 and the second wheel 14 when the first and second wheels 12, 14 are attached to the feet of the ladder. The first section 166 of the axle extension 164 extends in the direction of the longitudinal axis 162 of the axle 160 of the first wheel 12 toward the second wheel 14.

Axle extension 164 further includes a second section 180. Second section 164 of the axle extension 164 is aligned with the axle 160 in the second wheel 14. Second section 180 of the axle extension 164 includes a proximal end 182 that is unitary with the axle 160 in the second wheel 14 and a distal end 184 that is located between the first wheel 12 and the second wheel 14 when the first and second wheels 12, 14 are attached to the feet of the ladder. Second section 180 of the axle extension 164 extends in the direction of the longitudinal axis 162 of the axle 160 of the second wheel 14 toward the first wheel 12. The distal end 184 of the second section 172 of the axle extension 164 is telescopingly attached to the distal end 170 of the first section 166 of the axle extension 164 when the axle extension 164 is in use. A plurality of pin accommodating holes, such as pin accommodating hole 188, are defined in the first section 166 of the axle extension 164 near the distal end 170 of the first section 166 of the axle extension 164. A plurality of pin accommodating holes, such as pin accommodating hole 190, are defined in the second section 172 of the axle extension 164 near the distal end 184 of the second section 172 of the axle extension 164. A pin 192 connects one of the pin accommodating holes 188 in the first section 166 of the axle extension 164 to one of the pin accommodating holes 190 in the second section 172 of the axle extension 164 to attach the first section 166 to the second section 172 of the axle extension 164 when the axle extension 164 is in use.

A gear mechanism 200 is mounted on the first leg 52 of the U-shaped bracket 40 associated with the first wheel 12. The gear mechanism 200 includes an attaching arm 202 that is unitary with the axle 160 associated with the U-shaped bracket 40 associated with the first wheel 12. The attaching arm 202 is L-shaped and has a proximal end 204 that is unitary with the axle 160 associated with the first wheel 12 and a distal end 206 which is offset from the longitudinal axis 162 of the axle 160 associated with the first wheel 12.

A gear wheel 210 is rotatably mounted on the distal end 206 of the attaching arm 202 to rotate in a plane that is perpendicular to the longitudinal axis 162 of the axle 160 associated with the first wheel 12. The gear wheel 210 has an outer perimeter 212 and includes a plurality of gear teeth, such as gear tooth 214, on the outer perimeter 212.

An operating handle 220 includes a first section 222 which has a distal end 224 and a gear tooth-engaging element 226 on the distal end 224 of the first section 222 of the operating handle 220. The gear tooth-engaging element 226 engaging the gear teeth 214 of the gear wheel 210 to rotate the gear wheel 210. The first section 222 of the operating handle 220 further includes a proximal end 227 and a plurality of pin-accommodating holes, such as pin-accommodating hole 228, defined therein adjacent to the proximal end 227 of first section 222.

Operating handle 220 further includes a second section 230 which has a distal end 232, a proximal end 234, and a plurality of pin-accommodating holes, such as pin-accommodating hole 236, defined therein adjacent to the distal end 232 of the second section 230. The first section 222 of the operating handle 220 is telescopingly received in the second section 230 of the operating handle 220 whereby the overall length of the operating handle 220 can be adjusted to accommodate the height of the ladder.

A pin 238 is received through pin-accommodating holes 228, 236 defined in the first and second sections 222, 230 of the operating handle 220 to attach the first section 222 of the operating handle 220 to the second section 230 of the operating handle 220.

If suitable, an operating handle guide 250 can be mounted on the ladder and the operating handle 220 placed in the guide 250 to ensure easy contact between the operating handle 220 and the gear teeth 214. A foam rubber handgrip can be included on the operating handle 220 for comfort and a brake and brake handle can also be included. The brake can include a portion that engages at least one wheel 12, 14 or engages the gear teeth 214 to add stability to a ladder that may be used on an incline or on a sloping floor.

Operation of the accessory 10 can be understood from the foregoing. The wheels are attached to the feet of the ladder, and the overall length of the operating handle 220 is adjusted as necessary. The user then locates the ladder where suitable and ascends the ladder. If the ladder is to be moved, the user engages the gear tooth-engaging element 226 with the teeth 214 of the gear wheel 210 to move the teeth 214. Movement of the gear teeth 214 rotates gear wheel 210 which rotates the axle 160 extending through the first wheel 12 which rotates the axle extension 164 and the second wheel 14. Rotation of these two wheels 12, 14 moves the ladder. The operating handle 220 is moved again and again until the ladder is located where the user desires.

It is understood that while certain forms of the present invention have been illustrated and described herein, it is not to be limited to the specific forms or arrangements of parts described and shown.

What is claimed and desired to be covered by Letters Patent is as follows:

1. An accessory for a ladder comprising:

a) a set of wheels adapted to be mounted on feet of the ladder, said set of wheels including (1) first second, third and fourth wheels, each of the wheels being identical to the other wheels and each wheel having (A) a cylindrical body with an outer surface, (B) a first end, (C) a second end, (D) a longitudinal axis extending between the first end and the second end, (E) an axial bore extending along the longitudinal axis between the first end and the second end, and (F) longitudinal ribs on the outer surface of the cylindrical body, the longitudinal ribs extending from the first end to the second end, (2) a U-shaped bracket fixed to each of the wheels, each U-shaped bracket including (A) a bight section which has first and second ends, with the first end of the bight section being located adjacent to the first end of the wheel associated with the bracket and the second end of the bight section being located adjacent to the second end of the wheel associated with the bracket, the bight section further including a first surface located closely adjacent to the wheel associated with the bracket and a second surface, (B) a first leg on the first end of the bight section, the first leg being located closely adjacent to the first end of the wheel associated with the bracket, the first leg having a proximal end that is unitary with the bight section and a distal end that is located closely adjacent to the axial bore in the wheel associated with the bracket, the first leg having an axle-accommodating hole defined therethrough in the distal end thereof, the axle-accommodating hole being aligned with the axial bore in the wheel associated with the bracket, (C) a second leg on the second end of the bight section, the second leg being located closely adjacent to the second end of the wheel associated with the bracket, the second leg having a proximal end that is unitary with the bight section and a distal end that is located closely adjacent to the axial bore in the wheel associated with the bracket, the second leg having an axle-accommodating hole defined therethrough in the distal end thereof, the axle-accommodating hole being aligned with the axial bore in the wheel associated with the bracket, (D) a first L-shaped mounting element on the second surface of the bight section adjacent to the first end of the bight section of the bracket, the first L-shaped mounting element including (i) a body having a proximal end and a distal end, with the proximal of the body of the first L-shaped mounting element end being unitary with the bight section of the bracket, the distal end of the body of the first L-shaped mounting element being spaced apart from the second surface of the bight section of the bracket, (ii) a longitudinal axis extending between the distal end of the body of the first L-shaped mounting element and the proximal end of the body of the first L-shaped mounting element, the longitudinal axis of the body of the first L-shaped mounting element being oriented at a right angle with respect to the longitudinal axis of the bight section of the bracket, (iii) a first surface on the body of the first L-shaped mounting element, (iv) a second surface on the body of the first L-shaped mounting element, (v) a first L-shaped mounting element fastener-accommodating hole defined through the body of the first L-shaped mounting element from the first surface of the body to the second surface of the body near the distal end of the body of the first L-shaped mounting element, the body of the first L-shaped mounting element having a screw thread defined thereon adjacent to the fastener-accommodating hole of the first L-shaped mounting element, (vi) a head unitary with the distal end of the body of the first L-shaped mounting element, the head of the first L-shaped mounting elements having a proximal end unitary with the distal end of the body of the first L-shaped mounting element and a distal end spaced apart from the distal end of the body of the first L-shaped mounting element, the head of the first L-shaped mounting elements including a longitudinal axis extending between the proximal end of the head of the first L-shaped mounting elements and the distal end of the head of the first L-shaped mounting elements and extending in the direction of the longitudinal axis of the bight section of the bracket towards the second end of the bight section of the bracket, and (vii) a securing mechanism on the first surface of the body of first L-shaped mounting element, the securing mechanism including a mounting element fixedly mounted on the first surface of the body of the first L-shaped mounting element, the mounting element of the securing mechanism including a fastener-accommodating hole defined therethrough to be coincident with the fastener-accommodating hole defined through the body of the first L-shaped mounting element, the securing mechanism further including a screw thread defined on the body of the securing mechanism adjacent to the fastener-accommodating hole defined through the body of the securing mechanism, and a fastener accommodated in the fastener-accommodating holes defined through the mounting element of the securing mechanism and the hole defined through the body of the first L-shaped mounting element, the fastener of the securing mechanism including a screw thread that is threadably accommodated in the screw thread of the securing mechanism and the screw thread of the first L-shaped mounting element, the fastener further including a first end and a second end and a head on the first end of the fastener, the second end of the fastener being adapted to abuttingly engage one surface of a leg of the ladder when the wheel associated therewith is in place on a respective foot of the ladder, (E) a second L-shaped mounting element on the second surface of the bight section adjacent to the second end of the bight section of the bracket, the second L-shaped mounting element including (i) a body having a proximal end and a distal end, with the proximal end of the body of the second L-shaped mounting element being unitary with the bight section of the bracket, and the distal end of the body of the second L-shaped mounting element being spaced apart from the second surface of the bight section of the bracket, (ii) a longitudinal axis extending between the distal end of the body of the second L-shaped mounting element and the proximal end of the body of the second L-shaped mounting element, the longitudinal axis of the body of the second L-shaped mounting element being oriented at a right angle with respect to the longitudinal axis of the bight section of the bracket, (iii) a first surface on the body of the second L-shaped mounting element, (iv) a second surface on the body of the second L-shaped mounting element, and (v) a head unitary with the distal end of the body of the second L-shaped mounting element, the head of the second L-shaped mounting element having a proximal end unitary with the distal end of the body of the second L-shaped mounting element and a distal end spaced apart from the distal end of the body of the second L-shaped mounting element, the head of the second L-shaped mounting element including a longitudinal axis extending between the proximal end of the head of the second L-shaped mounting element and the distal end of the head of the second L-shaped mounting element and extending in the direction of the longitudinal axis of the bight section of the bracket towards the first end of the bight section of the bracket, and (F) when the first end of the fastener of the securing mechanism on the first L-shaped securing element is abuttingly engaged with the respective leg of the ladder, the U-shaped bracket associated with the securing mechanism being secured to the ladder;

b) an axle extending through the axial bore in each wheel, each axle being rotatably supported by the first and second legs of the bracket associated with each wheel adjacent to the axle-accommodating holes defined in the respective first and second legs, whereby each of the wheels is rotatably mounted on a U-shaped bracket by the respective axle, wherein each axle has a longitudinal axis;

c) an axle extension extending between the first and second wheels, said axle extension including (1) a first section, the first section of said axle extension being aligned with the axle in the first wheel, the first section of said axle extension including a proximal end that is unitary with the axle in the first wheel, a distal end that is located between the first wheel and the second wheel when the first and second wheels are attached to the feet of the ladder, the first section of said axle extension extending in the direction of the longitudinal axis of the axle of the first wheel toward the second wheel, (2) a second section, the second section of said axle extension being aligned with the axle in the second wheel, the second section of said axle extension including a proximal end that is unitary with the axle in the second wheel, a distal end that is located between the first wheel and the second wheel when the first and second wheels are attached to the feet of the ladder, the second section of said axle extension extending in the direction of the longitudinal axis of the axle of the second wheel toward the first wheel, the distal end of the second section of said axle extension being telescopingly attached to the distal end of the first section of said axle extension when said axle extension is in use, a plurality of pin-accommodating holes defined in the first section of said axle extension near the distal end of the first end of said axle extension, a plurality of pin-accommodating holes defined in the second section of said axle extension near the distal end of the second section of said axle extension, a pin connecting one of the pin-accommodating holes in the first section of said axle extension to one of the pin-accommodating holes in the second section of said axle extension to attach the first section of the axle extension to the second section of the axle extension when said axle extension is in use;

d) a gear mechanism mounted on the first leg of the U-shaped bracket associated with the first wheel, the gear mechanism including (1) an attaching arm unitary with the axle associated with the U-shaped bracket associated with the first wheel, the attaching arm being L-shaped and having a proximal end unitary with the axle associated with the first wheel and a distal end which is offset from longitudinal axis of the axle associated with the first wheel, and (2) a gear wheel rotatably mounted on the distal end of the attaching arm to rotate in a plane that is perpendicular the longitudinal axis of the axle associated with the first wheel, the gear wheel having an outer perimeter and including a plurality of gear teeth on the outer perimeter; and e) an operating handle, said operating handle including (1) a first section having a distal end, a gear tooth engaging element on the distal end of the first section of said operating handle, the gear tooth engaging element engaging the gear teeth of the gear wheel to rotate the gear wheel, the first section of said operating handle further including a proximal end and a plurality of pin accommodating holes defined therein adjacent to the proximal end of the first section, (2) a second section having a distal end and a proximal end and a plurality of pin-accommodating holes defined therein adjacent to the distal end of the second section, the first section of said operating handle being telescopingly received in the second section of said operating handle, and (3) a pin received through pin-accommodating holes defined in the first and second sections of said operating handle to attach the first section of the operating handle to the second section of the operating handle.

* * * * *